United States Patent [19]

Christian et al.

[11] Patent Number: 5,012,595

[45] Date of Patent: May 7, 1991

[54] ROTARY CROSS-BANDING VENEER DRYER

[76] Inventors: Everett R. Christian, 1829 Brookhurst, Medford; Michael E. Christian, P.O. Box 1344, Ashland; Theodore Z. Christian, 1557 #4, Medford, all of Oreg. 97520

[21] Appl. No.: 424,121

[22] Filed: Oct. 19, 1989

[51] Int. Cl.[5] ..... F26B 11/00

[52] U.S. Cl. ..... 34/187; 34/236

[58] Field of Search ..... 34/187, 186, 188, 21, 34/184, 107, 236

[56] References Cited

U.S. PATENT DOCUMENTS

| | | | |
|---|---|---|---|
| 1,558,835 | 10/1925 | Cathcart | 34/187 |
| 1,578,020 | 3/1926 | Elmendorf . | |
| 3,083,470 | 4/1963 | Pless . | |
| 4,067,318 | 1/1978 | Flaith et al. . | |
| 4,188,730 | 2/1980 | Allen et al. . | |
| 4,192,079 | 3/1980 | Brookhyser et al. . | |
| 4,193,207 | 3/1980 | Allen et al. . | |

*Primary Examiner*—Henry A. Bennet

*Attorney, Agent, or Firm*—Fleit, Jacobson, Cohn, Price, Holman & Stern

[57] ABSTRACT

A housing is provided in which a horizontal drum assembly is mounted for rotation at low rpm about a horizontal axis. The drum assembly includes a central foraminated cylinder outwardly from which foraminated peripherally spaced vanes extend in generally radial planes of the drum assembly. Each pair of peripherally adjacent vanes defines a pocket in which to receive a panel to be dried and structure is provided within the housing for upwardly discharging heated dry air toward the axis of rotation of the drum assembly from below the latter and with drawing warm moist air from an upper central portion of the housing above the drum assembly.

9 Claims, 2 Drawing Sheets

ROTARY CROSS-BANDING VENEER DRYER

BACKGROUND OF THE INVENTION

1. Field of the Invention

This invention relates to a dryer into which successive moisture laden veneer sheets may be introduced for drying in an efficient manner. The dryer may incorporate a single dryer unit, or a plurality of side by side units and each dryer unit includes approximately one hundred fifty compartments or pockets therein in which veneer which sheets or other moisture laden panels may be received for drying.

2. Description of Related Art

Various different forms of dryer apparatuses for drying wood veneer, timber and other materials are disclosed in U.S. Pat. Nos. 1,578,020, 3,083,470, 4,067,318 4,188,730, 4,192,079 and 4,193,207. However, these previously known forms of drying apparatuses do not include some of the major structural components of the instant invention or the overall combination of components utilized in the instant invention.

SUMMARY OF THE INVENTION

The dryer of the instant invention utilizes a rotary drum journaled for rotation about an horizontal axis, including a cylindrical central area and equipped with a plurality of generally radial foraminous support vanes spaced about and radiating outward from the central cylindrical area of the drum to provide radially extending pockets spaced peripherally about the drum between adjacent foraminated panels in which to receive high moisture content panels to be dried.

The drum is enclosed within a housing including a panel ingress slot with which successive aforementioned pockets are registerable and a panel egress slot with which the pockets are also successively registerable.

A lower portion of the interior of the housing below the drum includes burner means and the upper portion of the housing above the drum includes air outlet means with which the air inlet of a blower assembly is operatively communicated. The discharge of the blower assembly opens into the upper inlet ends of generally vertical ducts having refrigeration condenser coils therein and the lower ends of the ducts open into a manifold disposed in the lower portion of the housing below the drum and upwardly from which cooled dry air is discharged for movement upwardly toward the drum passed the aforementioned burner means. In addition, air pump means is provided within the interior of the housing in position for registry therewith by successive pockets and the air pump means is operative to direct a radial inward flow through each of the pockets registered therewith.

The main object of this invention is to provide a dryer in which veneer sheets and the like may be efficiently dried.

Another object of this invention is provide a dryer in accordance with the preceding object and which utilizes convection air flow to supplement blower means provided to effect upward circulation of heated dry air within the housing of the dryer as well as downward return of air being cooled and dried toward the bottom of the housing for re-introduction thereinto and heating prior to drying contact with panels being dried.

Another important object of this invention is to provide a dryer in accordance with the preceding objects and which requires very little controls for efficient operation thereof.

A final object of this invention to be specifically enumerated herein is to provide a dryer which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWING

FIG. 2 is an enlarged vertical sectional view taken substantially upon the plane indicated by the section line 2—2 of FIG. 1;

DESCRIPTION OF THE PREFERRED EMBODIMENT

Figure 1:
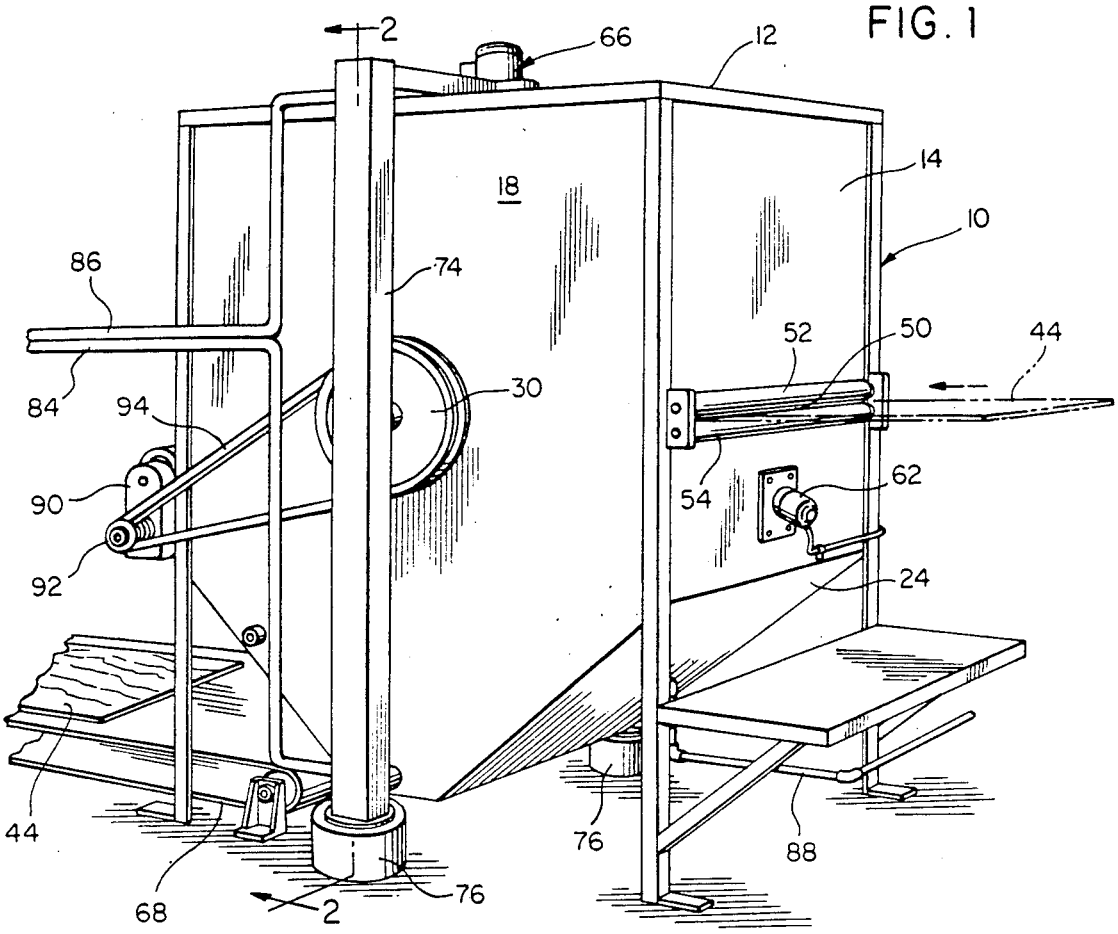
FIG. 1 is a perspective view of a dryer constructed in accordance with the present invention as seen from the panel inlet front side thereof.
Figure 4:
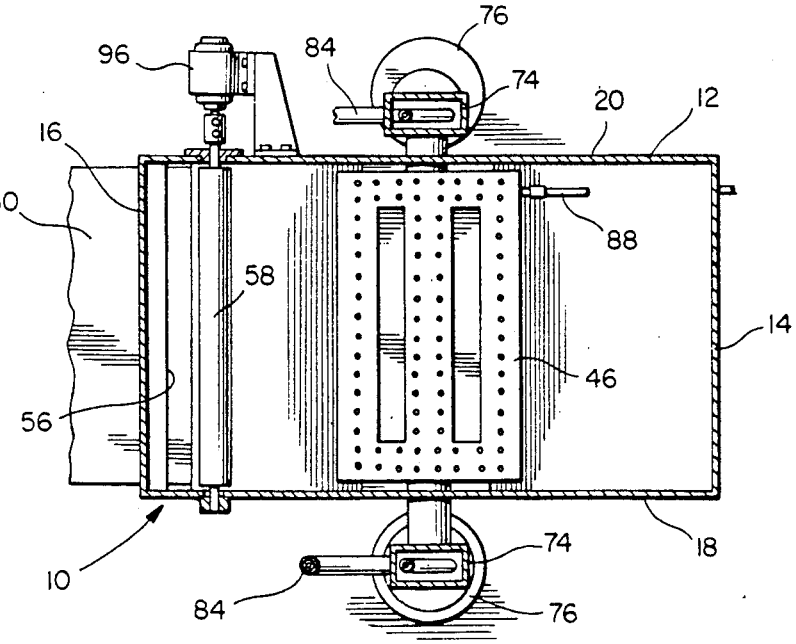
FIG. 4 is a horizontal sectional view taken substantially upon the plane indicated by the section line 4—4 of FIG. 2.
Figure 3:
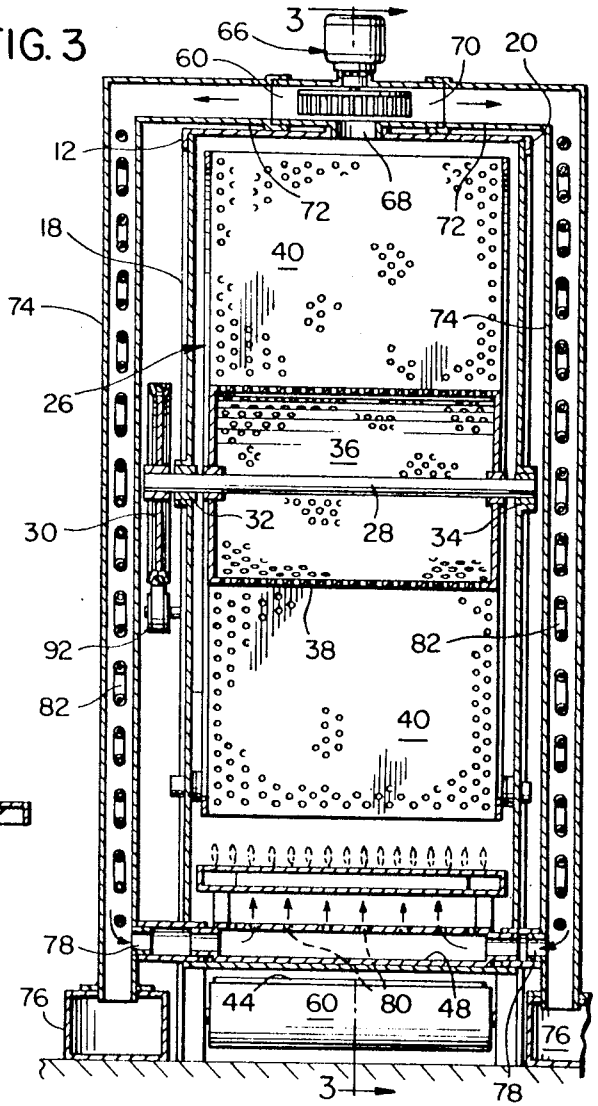
FIG. 3 is a vertical sectional view taken substantially upon the plane indicated by the section line 3—3 of FIG. 2.
Figure 3:
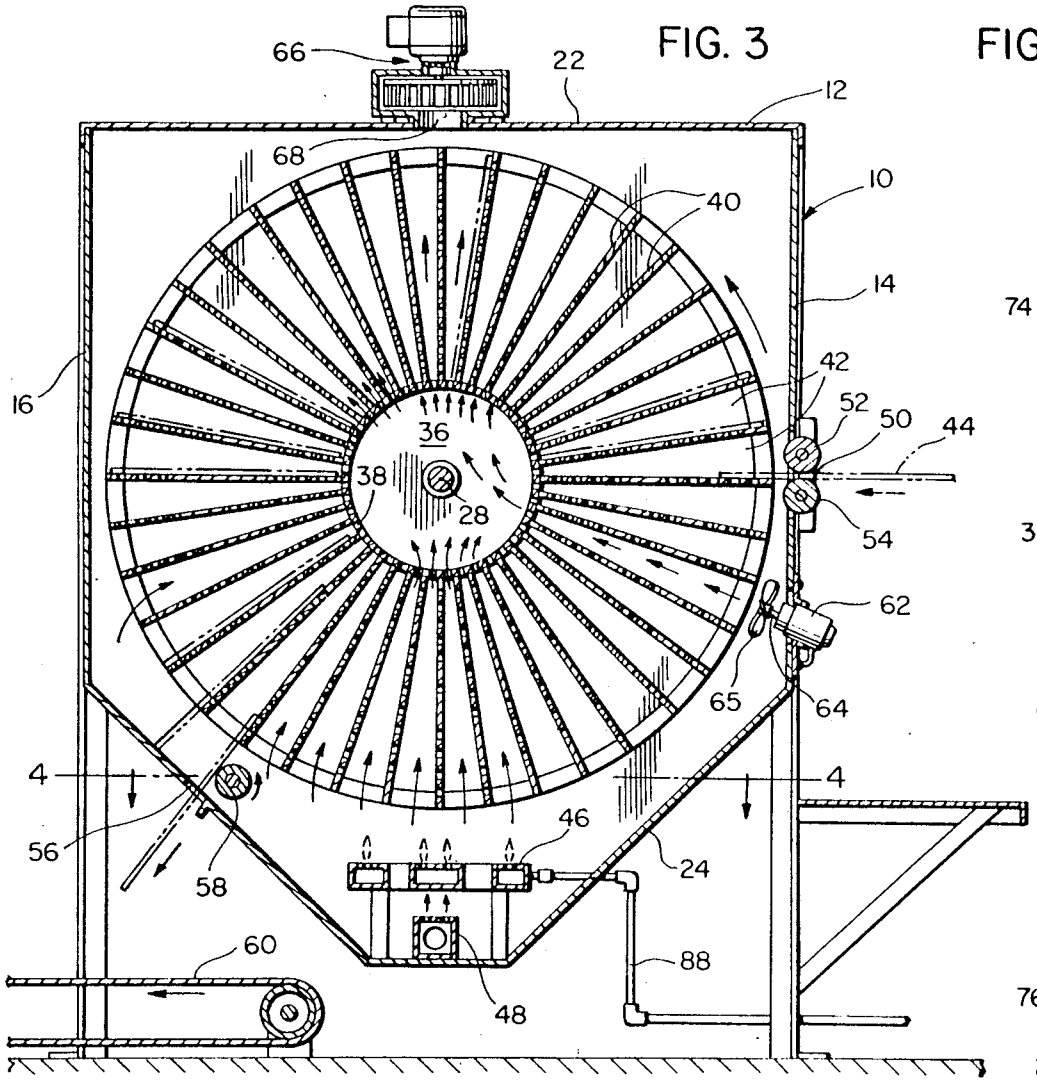

Referring now more specifically to the drawings the numeral 10 generally designates the dryer of the instant invention. The dryer 10 includes a closed housing 12 incorporating front and rear walls 14 and 16 and opposite side walls 18 and 20 extending between the front and rear walls 14 and 16. The top of the housing is closed by a top wall 22 and the bottom of the housing is closed by a hopper bottom 24.

A drum assembly 26 is journaled within the housing 12 by a central shaft 28 projecting outward through the side wall 18 and having a drive input pulley 30 mounted thereon, the shaft 28 being journaled from the side walls 18 and 20 through the utilization of suitable bearings 32 and 34.

A central cylindrical area 36 of the drum assembly 26 is defined by a foraminated cylinder 38 through which the shaft 28 extends axially and the drum assembly 26 includes a plurality (approximately 150) peripherally spaced foraminated vanes 40 extending outward from the cylinder 38 and each pair of peripherally adjacent foraminated vanes 40 define a radially outwardly opening pocket therebetween 42 in which to receive a panel 44 to be dried.

The drum assembly includes foraminated circular end panels (not shown), and the size of the openings formed through the end panels may be as desired and/or required for proper air flow through the pockets 42. In addition, the openings in the cylinder 38 and the vanes 40 also may be of a size as desired and/or required to facilitate proper air flow through the pockets.

The hopper bottom 24 of the housing 12 extends below the drum assembly 26 and has an elevated burner assembly 46 disposed therein. In addition, a log type manifold is disposed in the hopper bottom 24 below the burner assembly 46 and is operative to upwardly discharge air from within the manifold 48 upwardly past the burner assembly 46 and into the pockets 42 vertically registered with and immediately above the burner assembly 46.

The front wall 14 of the housing 12 defines a panel inlet slot 50 opening into the interior of the housing 12 between upper and lower horizontal rollers 52 and 54 and the hopper bottom 24 defines an outlet slot 56 having a driven kicker roller 58 operatively associated therewith by which panels may be discharged from the housing 12 onto an out conveyor 60 of any suitable type.

The front wall 14 of the housing 12 additionally supports an air circulation blower motor 62 therefrom and the motor 62 includes a rotary output shaft 64 having one end thereof disposed within the housing 12 and supporting an axial flow blade assembly 65 therefrom with which successive pockets 42 of the drum assembly 26 are registerable.

A blower assembly 66 is supported from the top wall 22 and has an air inlet 68 which opens downwardly through the top wall 22 into the interior of the housing 12 immediately above the drum assembly 26. The blower assembly 66 includes a pair of outlets 70 with which the upper horizontal inlet ends 72 of a pair of vertical side ducts 74 are registered and the side ducts 74 extend downwardly along and outwardly of the side walls 18 and 20. The lower ends of the ducts 74 open into condensation collection tanks 76 and further include lateral outlets 78 which open into opposite ends of the manifold 48. The manifold 48 includes upwardly opening outlets 80 for discharging air upwardly therefrom through the burner assembly 46 and the vertical portions of the ducts 74 include refrigeration coils 82 therein into whose lower ends cooled refrigerant supply pipes 84 open and from whose upper ends refrigerant return pipes 86 extend. The return pipes 86 return refrigerant to a source (not shown) of cooled refrigerant from which the supply pipes 84 extend. Further, a supply line 88 supplies fuel to the burner assembly 46 from a suitable source (not shown) of fuel.

A gear head motor 90 is mounted upon the rear wall 16 and includes a driven pulley 92 aligned with the pulley 30, an endless flexible drive member 94 being trained about the pulleys 92 and 30. Also, the kick roller 58 is driven by a motor 96 supported from the side wall 20.

Any suitable means (not shown) may be provided for receiving condensed water from the tanks 76 and any suitable controls (not shown) may be provided for intermittently driving the gear head motor 90. It is to be understood that the drum assembly 26 may be continuously or intermittently driven to rotate the drum assembly 26 between approximately one and twelve revolutions per hour. However, as may be appreciated, approximately one hundred fifty panels may be dried in an hour if the drum rotates only one time per hour and approximately eighteen hundred panels may be dried in one hour if the drum is rotated twelve times per hour.

In operation, panels 44 to be dried are inserted manually (or by machine) through the slot 50 as each pocket 42 registers with the slot 50. The inserted panels 44 are then elevated upwardly toward edge upstanding positions at the top of the drum assembly 26 and thereafter flop slightly toward gravity engagement with the vane 40 disposed immediately forward thereof in the direction of rotation of the drum assembly 26 and each panel 44 then moves downwardly toward the outlet slot 56 and engagement with the kicker roll 58 to thereby discharge successive panels 44 from the housing 12 onto the outlet conveyor 60.

During the drying process heated dry air moves upwardly through the empty pockets 42 along the lower periphery of the drum assembly 26 inwardly through the lower portion of the foraminated cylinder 38 and then outwardly through the upper portion of the foraminated cylinder 38 into the upper pockets 42 of the drum assembly 26 containing panels 44 to be dried. The moist heated air is then withdrawn from the top of the housing 12 by the blower assembly 66 and pumped downwardly through the ducts 74 over the condenser coils 82. During such downward movement a major portion of the moisture in the air passing downwardly through ducts 74 condenses out on the condenser coils 82 and falls downwardly from the lower ends of the ducts 74 into the tanks 76. The cool dried air then passes into the manifold 48 and is discharge upwardly therefrom through the openings 80 for passage upward through and passed the burner assembly 46 at which point the cooled dry air is heated to increase the quantity of water which may be evaporated thereby from the panels 44 disposed within the housing 12.

During operation of the dryer 10 the blade assembly 65 is operative to effect a radial inward flow of air through the pocket 42 registered therewith where upon additional heated and dry air passes inwardly to the interior of the cylinder 38 for discharge therefrom into the radial innermost ends of the radial pockets 42 carried by the upper periphery of the drum assembly 26. This additional circulation of heated dry air further increases the drying capacity of the dryer 10.

It is important to note that the axis of rotation of the drum assembly 26 preferably is horizontal, as disclosed. However, the drum assembly 36 could be rotated about a vertical axis, although the efficiency of the blade assembly 65 and convection air currents to assist in the movement of the major portion of drying air through the housing 12 by the blower assembly 66 would be reduced. In addition, a larger burner assembly 46 would be required as well as a plurality of manifolds 48 and perhaps a different type of internal air circulating structure to replace the blade assembly 65.

The foregoing is considered as illustrative only of the principles of the invention. Further, since numerous modifications and changes will readily occur to those skilled in art, it is not desired to limit the invention to the exact construction and operation shown and described, and accordingly, all suitable modification and equivalents may be resorted to, falling within the scope of the invention.

What is claimed as new is as follows:

1. A machine for drying panels, said machine including a closed housing, a drum mounted within said housing for rotation about a generally horizontal axis at least substantially stationary relative to said housing, said drum including a central cylindrical area and support means for support of a plurality of panels to be dried therefrom for rotation with said drum and with said panels arranged generally in radial planes of said axis and spaced about a central cylindrical area of said drum concentric with said axis, said support means including peripherally spaced apart, generally radial plane vanes carried by and extending outwardly from said cylindrical area, the peripheral spacing between adjacent vanes defining pockets opening radially outwardly of said drum assembly in which to receive panels to be dried, air flow means operative to effect an upward flow of heated dry air within said housing through said pockets between adjacent vanes supported from said drum, said housing including panel ingress and egress means through means which panels to be dried may be passed into the interior of said housing from the exterior thereof for support from said support means and rotation therewith and through which dried panels may be passed from supported position on said drum within said housing to the exterior thereof, said air flow means including means operative to withdraw warm moist air from an upper portion of the interior of said housing above said drum assembly and to upwardly discharge the last mentioned air from a lower portion of the interior of said housing below said drum assembly, and means for reducing the humidity of said last mentioned air subsequent to the withdrawal of said air from the upper portion of said housing and prior to upward discharge of said air within said lower portion of said housing.

2. The machine of claim 1 wherein said panel ingress means includes a horizontal slot-type opening in a first wall portion of said housing lying generally in a radial plane of said axis.

3. The machine of claim 2 wherein said panel egress means includes a horizontal slot-type opening in a second wall portion of said housing remote from said first wall portion and also lying generally in a radial plane of said axis.

4. The machine of claim 1 including air blowing means operative to blow air within said housing and outwardly of said drum assembly inwardly of the radial outermost extremities of said pockets and into the interior of said central area.

5. The machine of claim 4 wherein said central area is defined and bound by a central foraminated cylinder of said drum assembly from which said vanes are supported, said vanes also being foraminated.

6. The machine of claim 4 wherein said air blowing means is stationary relative to said housing and operative to blow air inwardly through said pockets as each pocket moves into registry with said air blowing means during rotation of said drum assembly.

7. The machine of claim 6 wherein said axis is generally horizontal.

8. The machine of claim 1 wherein said air flow means further includes means operative to heat said upward discharge of air within said lower portion of said housing.

9. A machine for drying panels, said machine including a closed housing, a horizontal drum assembly mounted within said housing for rotation about an horizontal axis, said drum assembly including means defining a foraminated cylinder partially enclosing a central cylindrical area of said drum, a plurality of peripherally spaced and generally radially outwardly projecting foraminated vanes extending outward from said foraminated cylinder in generally radial planes of said drum assembly, the spacing between peripherally adjacent foraminated panels defining outwardly opening pockets in which to receive panels to be dried, said housing including panel ingress and panel egress means with which said pockets are registerable and through which panels to be dried may be passed into the interior of said housing from the exterior thereof for reception in said pockets and for gravity support from and rotation with said drum assembly and through which dried panels may be passed from said pockets to the exterior of said housing, first means operative to effect an upward flow of heated dry air within said housing from below said drum assembly whereby a major portion of said heated air will flow upwardly through the pockets on the lower periphery of said drum assembly, into the interior of said foramined cylinder, upwardly through the upper portion of said foraminated cylinder into the inner extremities of the pockets defined by the upper periphery of said drum and outwardly from the radial outermost ends of the last mentioned pockets.

* * * * *